US009625926B1

(12) United States Patent
Hoque

(10) Patent No.: US 9,625,926 B1
(45) Date of Patent: Apr. 18, 2017

(54) MULTIPLE INPUT REGULATOR CIRCUIT

(71) Applicant: QUALCOMM Incorporated, San Diego, CA (US)

(72) Inventor: Mohammad Hoque, Chandler, AZ (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/945,320

(22) Filed: Nov. 18, 2015

(51) Int. Cl.
*G05F 1/575* (2006.01)

(52) U.S. Cl.
CPC ..... *G05F 1/575* (2013.01)

(58) Field of Classification Search
CPC . G05F 1/462; G05F 1/56; G05F 1/575; G05F 5/00; H02M 1/158; H02M 1/155; H02M 1/157; H02M 3/156
USPC ..... 323/280, 273, 282–285, 299, 303, 351
See application file for complete search history.

(56) References Cited

U.S. PATENT DOCUMENTS 5,180,965 A 1/1993 Nose
6,400,209 B1 6/2002 Matsuyama et al.
8,116,051 B2 2/2012 Nakahara
8,120,390 B1 * 2/2012 Mack ..... G05F 1/56 327/108
8,536,845 B2 9/2013 Kim et al.
2007/0236279 A1 10/2007 Novak
2009/0278609 A1 * 11/2009 Srinivasan ..... H03F 1/0216 330/297
2009/0322295 A1 * 12/2009 Scoones ..... G05F 1/56 323/282
2010/0060078 A1 3/2010 Shaw
2012/0038213 A1 * 2/2012 Vogel ..... H02J 9/061 307/64
2013/0038131 A1 * 2/2013 Nishigata ..... G06F 1/263 307/80
2014/0266143 A1 9/2014 Saint-Laurent et al.
2015/0069983 A1 3/2015 Hawawini et al.
2015/0108842 A1 4/2015 Chen et al.

FOREIGN PATENT DOCUMENTS

CN 203204489 U 9/2013

OTHER PUBLICATIONS

International Search Report for PCT Application No. PCT/US2016/059125 issued by the European ISA on Feb. 16, 2017; pp. 1-4.
Written Opinion for PCT Application No. PCT/US2016/059125 issued by the European ISA on Feb. 16, 2017; pp. 1-12.

* cited by examiner

*Primary Examiner* — Adolf Berhane
(74) *Attorney, Agent, or Firm* — Haynes and Boone, LLP

(57) ABSTRACT

The embodiments described herein relate to an improved circuit technique for a multiple input regulator circuit having multiple power paths therein. The multiple input regulator circuit may be configured to minimize integrated circuit area by utilizing a single power transistor in the power path from each of the power sources to the output of the regulator circuit. The single power transistor is adapted to provide both power source selection and power source regulation functions, thus replacing the power selection transistor and the power regulation transistor of conventional designs.

24 Claims, 7 Drawing Sheets

MULTIPLE INPUT REGULATOR CIRCUIT

FIELD OF THE INVENTION

At least certain embodiments disclosed herein relate generally to electronic circuits, and more particularly to an improved regulator circuit configuration.

BACKGROUND

Electronic systems typically require one or more regulated voltages to power various subsystems. A regulator is a circuit that may receive an input voltage and produce a regulated output voltage that may be at a different voltage level than the input voltage. One common type of regulator circuit is a low dropout regulator ("LDO"). An LDO regulator is a DC linear voltage regulator which can regulate the output voltage even when the input (or supply) voltage is close to the output voltage.

Switched-mode chargers, linear battery chargers, buck/boost regulators, and other related power charging devices include an onboard LDO circuit configured to supply power to the low side and high side of power transistor drivers. Such an LDO regulator circuit usually includes multiple input power sources. For a single-input charger, the LDO regulator usually has two power sources such as universal serial bus ("USB") input power source and battery input power source. Whereas for a dual-input charger, the LDO regulator usually has three power sources such as USB, direct current ("DC"), and battery power sources.

To support multiple input power sources, LDO regulators include selection logic configured for selecting an active power path from among the multiple power paths of the input power sources, and for preventing back power leakage from the active power path into the inactive power paths. The LDO regulator should therefore be adapted to select and power up from each of the multiple input power sources, and also to isolate the multiple power sources from one another to prevent back power leakage.

Conventionally this multiple input power path selection option is addressed using an input power multiplexer ("MUX") in the LDO regulator as the selection logic to select the input power source (e.g., USB, DC, or battery) that will supply power to the LDO regulator output. The MUX selection logic configuration requires two or more power transistors in the series in the power path from the input power source to the output of the LDO regulator. Power transistors are generally large due to the fact that they conduct power from the power source to the output of the LDO regulator circuit. Having multiple transistors in series in the power path is therefore expensive in terms of integrated circuit device area.

FIG. 1 depicts an example circuit diagram of a conventional LDO regulator circuit configuration using MUX selection logic in the power path. In the figure circuit 10 includes a power MUX 101 coupled with a LDO regulator circuit 120. Notably there are two or more power transistors in series in each of the power paths from the input power sources to the output LDO_Out of the LDO regulator circuit.

The power MUX 101 includes a power P-type Field Effect Transistor ("PFET") 102 in the first power path from the first power source PWR_SRC1 (USB) to LDO_Out. An enable signal EN_Path1 is received at the gate terminal of PFET 102 via an inverter circuit 105 to activate or deactivate the power PFET 102 in the first power path based on the polarity of the enable signal EN_Path1. Power MUX 101 further includes two power PFETs 104 and 106 in series in the second power path from the second power source PWR_SRC2 (Battery) to LDO_Out. An enable signal EN_Path2 is received at the gate terminal of power PFETs 104 and 106 via an inverter circuit 107 to activate or deactivate the power PFETs 104 and 106 in the second power path based on the polarity of the enable signal EN_Path2.

In addition, PFETs 102, 104 and 106 are further connected in series with PFET 108 in the LDO regulator 120 in the first and second power paths, respectively. The PFET 108 is activated and deactivated by operational amplifier 110 in the LDO regulator 120. Thus in the conventional configuration of circuit 10, there are two power PFETs 102 and 108 connected in series in the first power path and three power PFETs 104, 106 and 108 connected in series in the second power path.

Power transistors are required to conduct power from the power source to the output of the LDO regulator. The device size of power transistors must therefore be large to accommodate conducting power in the circuit. Additionally PFETs are typically larger in size than N-type Field Effect Transistors ("NFETs"). Minimizing the number and size of the power transistors in the power path is therefore desirable in order to decrease the overall cost of the LDO regulator circuit in terms of integrated circuit device area.

SUMMARY

The embodiments described herein relate to an improved circuit technique in a multiple input regulator circuit. In at least certain embodiments, the regulator circuit may include a LDO regulator circuit. In one embodiment, the regulator circuit comprises a first power path and at least a second power path. The first power path includes (1) only a single first power transistor connected in series between a first input power source and output of the regulator circuit, and (2) a first switch having an output coupled with the body terminal of the first power transistor to selectively connect the body terminal of the first power transistor to ground potential based on the polarity of a first path enable signal. The second power path includes (1) only a single second power transistor connected in series between a second input power source and the output of the regulator circuit, and (2) a second switch having an output coupled with the body terminal of the second power transistor to selectively connect the body terminal of the second power transistor to ground potential based on the polarity of a second path enable signal.

The regulator circuit is configured to select which input power source supplies power to the output of the regulator circuit based on the polarities of the path enable signals. The first path enable signal and the second path enable are configured to activate only the first power path or the second power path at any one time based on the polarities of the first and second path enable signals, and to prevent back power leakage from the active power path into one or more inactive power paths. The single power transistors in the power paths are adapted to provide both power source selection and power source regulation functions.

When the first power transistor is conducting power from the first input power source to the output of the regulator circuit, the gate and backgate terminals of the second power transistor are selectively connected to ground potential based on the polarity of the second path enable signal, and when the second power transistor is conducting power from the second input power source to the output of the regulator circuit, the gate and backgate terminals of the first power transistor is selectively connected to ground potential based on the polarity of the first power enable signal.

The regulator circuit further comprises a regulation amplifier circuit including a first pass gate circuit coupled between ground potential and a first current source configured to activate or deactivate the first power transistor, and a second pass gate circuit coupled between ground potential and a second current source configured to activate or deactivate the second power transistor. The regulation amplifier circuit further includes an operational amplifier having its output coupled with the first pass gate circuit and the second pass gate circuit to selectively connect the first pass gate circuit or the second pass gate circuit to ground potential based on the polarities of the first and second path enable signals. The operational amplifier includes a first amplifier input terminal coupled with a reference voltage and a second amplifier input terminal coupled to receive a feedback voltage from a resistor divider network coupled with the output of the regulator circuit.

In at least certain embodiments the regulator circuit can further include additional power paths and corresponding path enable signals. The regulator circuit is configured to select which input power source supplies power to the output of the regulator circuit based on the polarities of the respective path enable signals.

In another embodiment, a method in a regulator circuit is disclosed. The method includes alternatively receiving a first path enable signal at a first power path and at least a second path enable signal at a second power path. The first power path comprises (1) only a single first power transistor connected in series between a first input power source and the output of the regulator circuit, and (2) a first switch having an output coupled with the body terminal of the first power transistor, and the second power path comprises (1) only a single second power transistor connected in series between a second input power source and the output of the regulator circuit, and (2) a second switch having an output coupled with the body terminal of the second power transistor.

The method further comprises selectively connecting either the body terminal of the first power transistor to ground potential based on the polarity of the first path enable signal, or connecting the body terminal of the second power transistor to ground potential based on the polarity of the second path enable signal. Only one power path is activated at a time based on the polarities of the first and second path enable signals to prevent back power leakage from an active power path into one or more of the inactive power paths.

In yet other embodiments, a regulator circuit means is disclosed. The regulator circuit means includes a means for receiving a first path enable signal at a first power path and at least a means for receiving a second path enable signal at a second power path. The first power path comprises (1) only a single first power transistor connected in series between a first input power source and the output of the regulator circuit, and (2) a first switch having an output coupled with the body terminal of the first power transistor, and the second power path comprises (1) only a single second power transistor connected in series between a second input power source and the output of the regulator circuit, and (2) a second switch having an output coupled with the body terminal of the second power transistor.

The regulator circuit means further includes a means for selectively connecting either the body terminal of the first power transistor to ground potential based on a polarity of a first path enable signal, or connecting the body terminal of the second power transistor to ground potential based on a polarity of a second path enable signal, where only one power path is active at a time based on the polarities of the path enable signals to prevent back power leakage from an active power path into one or more of the inactive power paths.

The following detailed description and accompanying drawings provide a better understanding of the nature and advantages of the present invention.

BRIEF DESCRIPTION OF THE DRAWINGS

For a better understanding of at least certain embodiments, reference will be made to the following detailed description, which is to be read in conjunction with the accompanying drawings.

DETAILED DESCRIPTION

Throughout the description, for the purposes of explanation, numerous specific details are set forth in order to provide a thorough understanding of the present invention. It will be apparent to one skilled in the art, however, that the techniques described herein may be practiced without some of these specific details. In other instances, well-known structures and devices may be shown in block diagram form to avoid obscuring the underlying principles of the invention.

I. Exemplary Circuit

Provided below is a description of an example circuit upon which the embodiments described herein may be implemented. Although certain elements may be depicted as separate components, in some instances one or more of the components may be combined into a single component or device. Likewise, although certain functionality may be described as being performed by a single element or component within the circuit, the functionality may in some instances be performed by multiple elements or components working together in a functionally coordinated manner.

In addition, hardwired circuitry may be used independently or in combination with firmware or software to implement the novel circuit techniques described herein. The described functionality may be performed by custom hardware components containing hardwired logic for performing operations, or by any combination of hardware, firmware, and software programmed computer components. The techniques described herein are not limited to any specific combination of hardware circuitry.

As discussed above, minimizing integrated circuit device area in the power path of an LDO regulator circuit is desirable. In addition, for multiple input LDO regulator circuits, isolating the power paths from one another prevents back power leakage from the active power path to one or more of the inactive power paths. The circuit techniques described herein are implemented with a single power transistor connected in series in each of the power paths from the respective power sources to the output of the LDO regulator circuit in order to minimize the integrated circuit device area. Also the single power transistor is implemented as an NFET device instead of a PFET device to further increase the integrated circuit device area savings since PFET devices typically occupy more integrated circuit device area than NFET devices. The single power NFET in each power path is configured to provide both power source selection and power source regulation functions.

Figure 1:
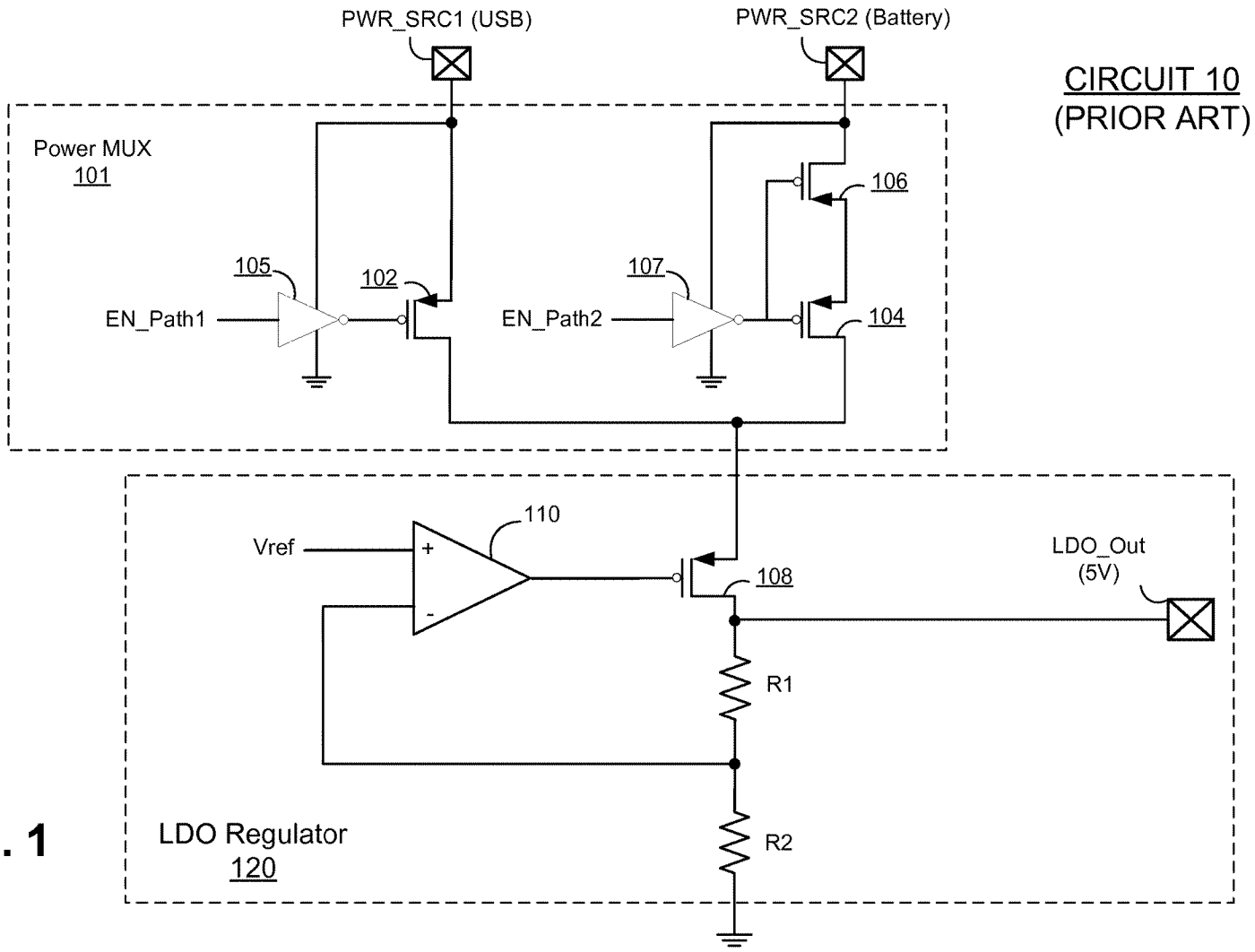
FIG. 1 depicts a circuit diagram of a prior art low dropout regulator circuit configuration using multiplexer selection logic in the power path.
Figure 2:
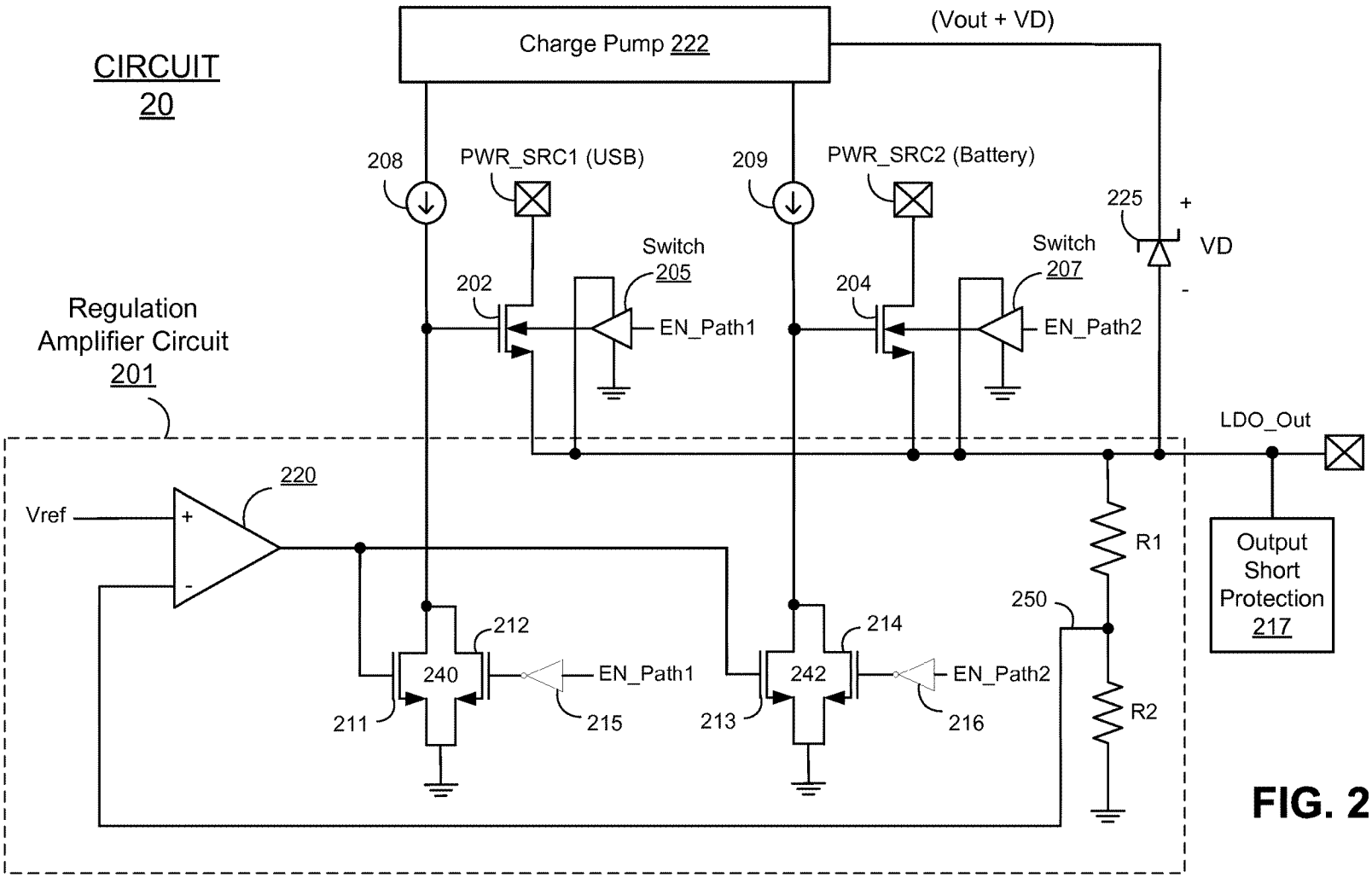
FIG. 2 depicts a circuit diagram of an example embodiment of a two-input LDO regulator circuit configuration including a single transistor in the power path.

FIG. 2 depicts a circuit diagram of an example embodiment of a two-input LDO regulator circuit configuration including a single transistor in the power path. In the illustrated embodiment, circuit 20 includes a first power path from a first power source PWR_SRC1 (USB) through a first power NFET 202 to the output of the LDO regulator circuit LDO_Out, and a second power path from a second power source PWR_SRC2 (Battery) through a second power NFET 204 to LDO_Out. A first switch circuit 205 is coupled with the body terminal of the first power NFET 202 to selectively connect the body terminal of NFET 202 to ground based on the polarity of the first power path enable signal EN_Path1 received at the input of the first switch circuit 205. A second switch circuit 207 is coupled with the body terminal of the second power NFET 204 to selectively connect the body terminal of NFET 204 to ground based on the polarity of the second power path enable signal EN_Path2 received at the input of the second switch circuit 207.

The first and second power path enable signals EN_Path1 and EN_Path2, respectively, are configured to activate only the first power path or the second power path at any given time based on the polarities of the first and second path enable signals EN_Path1 and EN_Path2, respectively. When the first power path is enabled, the body terminals of the second power NFET 204 is selectively connected to ground potential via the second switch 207 based on the polarity of the second path enable signal EN_Path2, and when the second power NFET 204 is activated and conducting power from the second input power source PWR_SRC2 to LDO_Out, the body terminal of the first power NFET 202 is selectively connected to ground potential via the first switch 205 based on the polarity of the first power enable signal EN_Path1.

In one embodiment, the switches 205 and 207 comprise back gate switches implemented using tristate buffer circuits to selectively connect to ground the back gate (i.e., body terminal) of the transistors 202 and 204. Tristate logic allows an output to assume a high impedance state in addition to high and low logic levels, effectively removing the output from the circuit. The high-impedance ("Hi-Z") state is adapted to remove the device's influence from the rest of the circuit when activated. When activated the output of the tristate buffer follows the input like turning a switch on. When the outputs are tri-stated (i.e., in the Hi-Z state) their influence on the rest of the circuit is removed, and the output node of the tristate buffer will be "floating" when no other circuit element is driving its state. It should be noted however that the embodiments described herein are not limited to using tristate buffers, as persons of skill in the art will appreciate that other equivalent selection logic may be utilized.

The LDO regulator circuit 20 is therefore configured to select which input power source to supply power to the output LDO_Out based on the polarities of the first and second path enable signals, and to prevent back power leakage from the active power path into one or more of the inactive power paths.

When the first power NFET 202 is enabled and conducting power from the first input power source PWR_SRC1 to the output LDO_Out, the polarity of the first power path enable signal EN_Path1 can be set high (i.e., logic state 1) and the polarity of the second power path enable signal EN_Path2 can be set low (i.e., logic state 0). The first switch 205 coupled with the body terminal of the first power NFET 202 will be in its Hi-Z state and the second switch 207 coupled with the body terminal of the second power NFET 204 will be conducting and will connect the body terminal of the second power NFET 204 to ground.

And when the second power NFET 204 is enabled and conducting power from the second input power source PWR_SRC2 to the output LDO_Out, the polarity of the second power path enable signal EN_Path2 can be set high (i.e., logic state 1) and the polarity of the first power path enable signal EN_Path2 can be set low (i.e., logic state 0). The second switch 207 coupled with the body terminal of the second power NFET 204 will be in its Hi-Z state and the first switch 205 coupled with the body terminal of the first power NFET 202 will be conducting and will connect the body terminal of the first power NFET to ground.

Circuit 20 further includes a regulation amplifier circuit 201 coupled with the first and second power paths. The regulation amplifier circuit 201 includes a first pass gate circuit 240 comprising NFET devices 211 and 212, a second pass gate circuit 242 comprising NFET devices 213 and 214, and an operational amplifier 220. The first pass gate circuit 240 is coupled between ground and a first current source 208. The first current source 208 is configured to activate or deactivate the gate terminal of the first power NFET 202 to permit power to flow through the first power path from the first power source PWR_SRC1 to the output LDO_Out. Similarly, the second pass gate circuit 242 is coupled between ground and a second current source 209. The second current source 209 is configured to activate or deactivate the gate terminal of the second power NFET 204 to permit power to flow through the second power path from the second power source PWR_SRC2 to the output LDO_Out.

The operational amplifier 220 includes a first input terminal configured to receive a reference voltage Vref and a second input terminal coupled to receive a feedback voltage from a resistor divider network comprising resistors R1 and R2 coupled with the output LDO_Out of the LDO regulator circuit. The operational amplifier 220 includes an output voltage configured to regulate the voltage at both of the gate terminals of NFET 211 of the first pass gate circuit 240 and NFET 213 of the second pass gate circuit 242. The reference voltage Vref can be set equal to the voltage across resistor R1 subtracted from the value of the output voltage at LDO_Out when the LDO regulator circuit 20 is conducting power. The operational amplifier 220 is configured such that when the voltage at both its inputs approaches the same value, the operational amplifier 220 will conduct at its output.

When one of the power paths in the LDO regulator circuit 20 is conducting, the voltage at the node 250 becomes comparable to the reference voltage Vref (i.e., Vout-VR1). When this happens, the output of the operational amplifier 220 will regulate the gate terminals of NFETs 211 and 213 of the first and second pass gate circuits 240 and 242, respectively. The first and second pass gates 240 and 242 can then be selectively activated or deactivated based on the first and second power path enable signals EN_Path1 and EN_Path2 received at the gate terminals of the other NFETs 212 and 214 of the first and second pass gate circuits 240 and 242, respectively.

When power is conducting in the first power path, the first path enable signal EN_Path1 will be active (and EN_Path2 will be inactive) and NFET 214 of the second pass gate circuit 242 will be activated based on the polarity of the second power path enable signal EN_Path2. NFET 212 of the first pass gate 240 will be deactivated (and floating) since the first power path enable signal EN_Path1 received at the gate terminal of NFET 212 will be inverted to a low logic state via inverter circuit 215. In this configuration, power conducts in the first power path and the second power path is connected to ground via the transistor NFET 214 of the second pass gate circuit 242. The second pass gate circuit 242 and the second switch 207 are therefore configured to function together to connect the gate and back gate terminals (i.e., body terminal) of the second power NFET 204 to ground, respectively, thus isolating the second power path while the first power path is conducting.

And when power is conducting in the second power path, the second path enable signal EN_Path2 will be active (and EN_Path2 will be inactive) and NFET 212 of the first pass gate circuit 240 will be activated based on the polarity of the first power path enable signal EN_Path1. NFET 214 of the second pass gate 242 will be deactivated (and floating) since the second power path enable signal EN_Path2 received at the gate terminal of NFET 214 will be inverted to a low logic state via inverter circuit 216. In this configuration, power conducts in the second power path and the first power path is connected to ground via the first pass gate circuit 240. The first pass gate 240 and the first switch 205 therefore function together to connect the gate and back gate terminals of the first power NFET 202 to ground, respectively, thus isolating the first power path while the second power path is conducting.

Therefore only one of the pass gate circuits 240 or 242 will conduct at any given time based on the polarities of the first and second power path enable signals EN_Path1 and EN_Path2. When the first power path is active and conducting, the switch 207 and the second pass gate circuit 242 work together to connect the gate and back gate terminals of the second power FET 204 to ground, and when the second power path is active and conducting, switch 205 and the first pass gate circuit 240 work together to connect the gate and back gate terminals of the first power FET 202 to ground.

Circuit 20 further includes a charge pump circuit 222 designed to generate current sources 208 and 209 at a current and voltage level high enough (e.g., 10-30 μA) to activate the power FETs 202 and 204, respectively. The charge pump circuit 222 provides the current sources 208 and 209 to drive the gates of the first and second power FETs 202 and 204 in their respective first and second power paths. In the illustrated embodiment, charge pump circuit 222 is maintained at the output voltage Vout+VD (where VD is the voltage across zener diode—or other voltage clamp circuit 225—typically in the range of 6 volts). The zener diode or voltage clamp circuit 225 is provided to maintain (i.e., clamp) the charge pump voltage within a specified range. Circuit 20 can also include an output short protection circuit 217 to prevent the output voltage of the LDO regulator circuit from shorting when active power flows in the LDO regulator circuit 20.

This completes the description of LDO regulator circuit 20 according to one example embodiment. It should be noted that the circuit described herein is not limited to active-high or active-low power path enable signals, and can be designed with either active-high or active-low enable, and the circuit reconfigured accordingly, as such is a mere design choice for a circuit designer.

It should also be noted that, although certain embodiments may be described herein as utilizing Field Effect Transistor ("FET") technology, the circuit techniques described herein are not limited to any particular transistor technology. It will be appreciated by persons of skill in the art that other types of transistors or equivalent devices may be used to implement the circuit techniques described herein. For example, embodiments may be implemented using MOSFET, JFET, BJT, IGBT, GaAs, etc. In addition, it should further be noted that although the techniques described herein are based on an NFET transistor configuration, persons of skill in the art will appreciate that many of the disclosed embodiments can also be implemented based on a PFET transistor configuration.

It should further be noted that although the embodiments described herein include receiving power via USB, DC, or battery power inputs, the techniques described herein are not so limited, and can be configured to receive input power from any type of power source, of which USB, DC, or battery power inputs are only examples.

Figure 3:
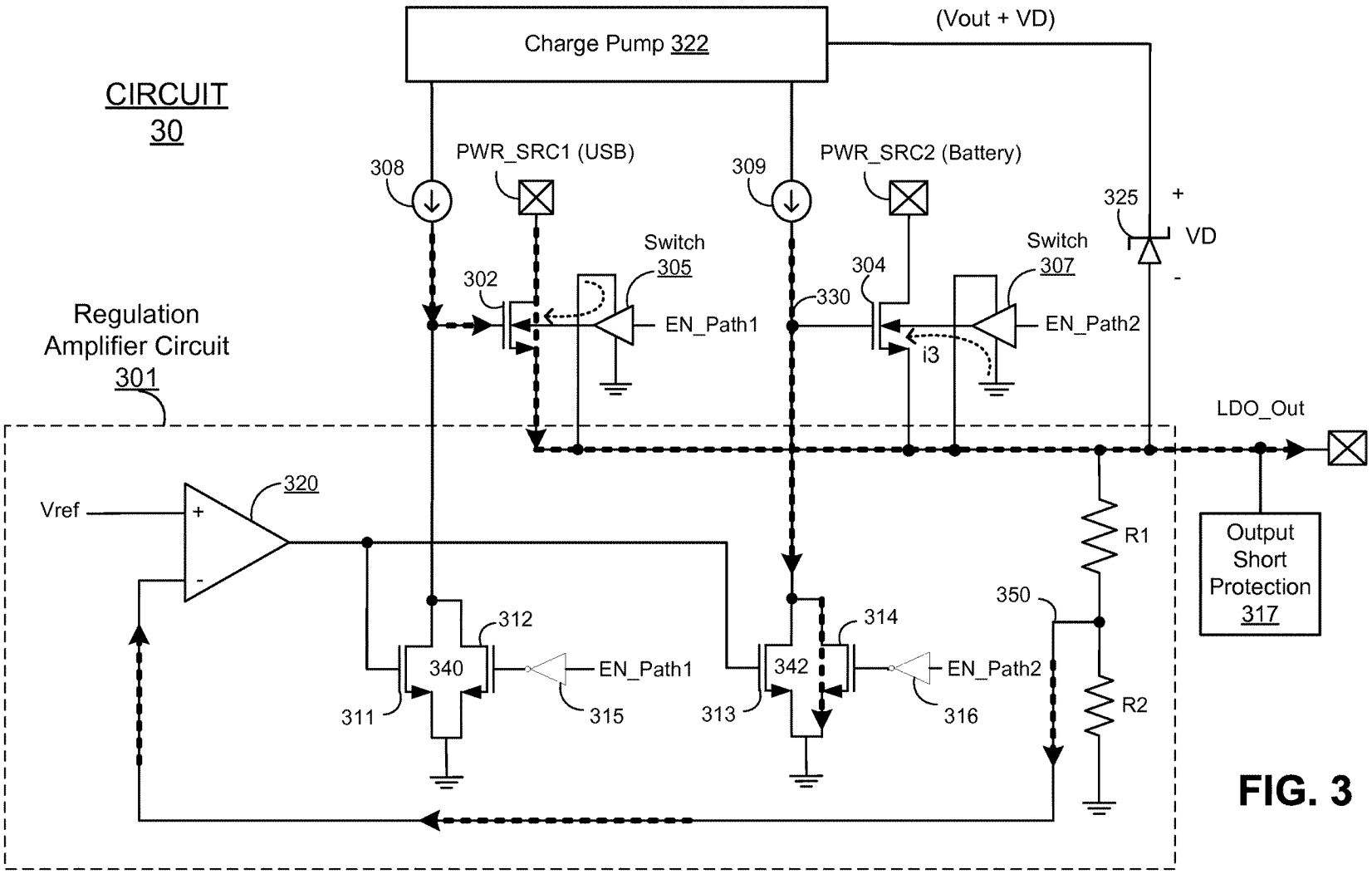
FIG. 3 depicts an equivalent circuit diagram of the example embodiment of the two-input LDO regulator circuit configuration of FIG. 2 when the first power transistor in the first power path is conducting and the gate and backgate of the second power transistor in the second power path is connected to ground potential.

FIG. 3 depicts an equivalent circuit diagram of the example embodiment of the two-input LDO regulator circuit configuration of FIG. 2 when the first power transistor in the first power path is conducting and the gate and backgate of the second power transistor in the second power path is connected to ground potential. In the illustrated embodiment, circuit 30 includes a first power path from a first power source PWR_SRC1 (USB) through a first power NFET 302 to the output of the LDO regulator circuit LDO_Out, and a second power path from a second power source PWR_SRC2 (Battery) through a second power NFET 304 to the output LDO_Out. A first switch circuit 305 is coupled with the body terminal of the first power NFET 302 to selectively connect the body terminal of the first power NFET 302 to ground based on the polarity of the first power path enable signal EN_Path1 received at the input of the first switch circuit 305. A second switch circuit 307 is coupled with the body terminal of the second power NFET 304 to selectively connect the body terminal of the second power NFET 304 to ground based on the polarity of the second power path enable signal EN_Path2 received at the input of the switch circuit 307.

As shown in the illustrated embodiment of FIG. 3, when the first power path is enabled and conducting, the back gate of the second power NFET 304 is selectively connected to ground potential via the second switch 307 based on the polarity of the second path enable signal EN_Path2. The tristate buffer switch 307 is closed and current i3 conducts therein, thus selectively connecting the body terminal of the second power FET 304 to ground potential. When the first power NFET 302 is enabled and conducting power from the first input power source PWR_SRC1 to the output LDO_Out, the polarity of the first power path enable signal EN_Path1 can be set high (i.e., logic state 1) and the polarity of the second power path enable signal EN_Path2 can be set low (i.e., logic state 0). The first switch 305 coupled with the body terminal of the first power NFET 302 will be in its Hi-Z state and the second switch 307 coupled with the body terminal of the second power NFET 304 will be conducting and will connect the body terminal of the second power NFET 304 to ground.

Circuit 30 further includes a regulation amplifier circuit 301 coupled with the first and second power paths. The regulation amplifier circuit 301 includes a first pass gate circuit 340 comprising NFET devices 311 and 312, a second pass gate circuit 342 comprising NFET devices 313 and 314, and an operational amplifier 320. The first pass gate circuit 340 is coupled between ground and a first current source 308. The first current source 308 activates the gate terminal of the first power NFET 302 to permit power to flow through the first power path from the first power source PWR_SRC1 to the output LDO_Out. The second pass gate circuit 342 is coupled between ground and a second current source 309. As shown, the second current source 309 drives current to ground via NFET 314 of pass gate circuit 342.

The operational amplifier 320 includes a first input terminal configured to receive a reference voltage Vref and a second input terminal coupled to receive a feedback voltage from a resistor divider network comprising resistors R1 and R2 coupled with the output LDO_Out. The operational amplifier 320 includes an output voltage coupled with the gate terminals of NFET 311 of the first pass gate circuit 340 and NFET 313 of the second pass gate circuit 342. The reference voltage Vref can be set equal to the voltage across resistor R1 subtracted from the value of the output voltage at the output LDO_Out when the LDO regulator circuit 30 is conducting power. The first pass gate circuit 340 is selectively deactivated based on the first power path enable signals EN_Path1 received at the gate terminal of NFET 312 via inverter 315. The second pass gate circuit 342, on the other hand, is selectively activated based on the polarity of the second power path enable signal EN_Path2 received at the gate terminal of NFET 314 of the second pass gate circuit 342.

As shown in the illustrated embodiment of FIG. 3, when power is conducting in the first power path, the first path enable signal EN_Path1 will be active (and EN_Path2 will be inactive) and NFET 314 of the second pass gate circuit 342 will be activated based on the polarity of the second power path enable signal EN_Path2. NFET 312 of the first pass gate 340 will be deactivated (and floating) since the first power path enable signal EN_Path1 received at the gate terminal of NFET 312 will be inverted to a low logic state via inverter circuit 315. In this configuration, power conducts in the first power path and the second power path is connected to ground.

Similar in functionality to the discussion above with respect to FIG. 2, circuit 30 further includes a charge pump circuit 322, a zener diode or voltage clamp circuit 325, and an output short protection circuit 317. This completes the description of LDO regulator circuit 30 according to one example embodiment.

Figure 4:
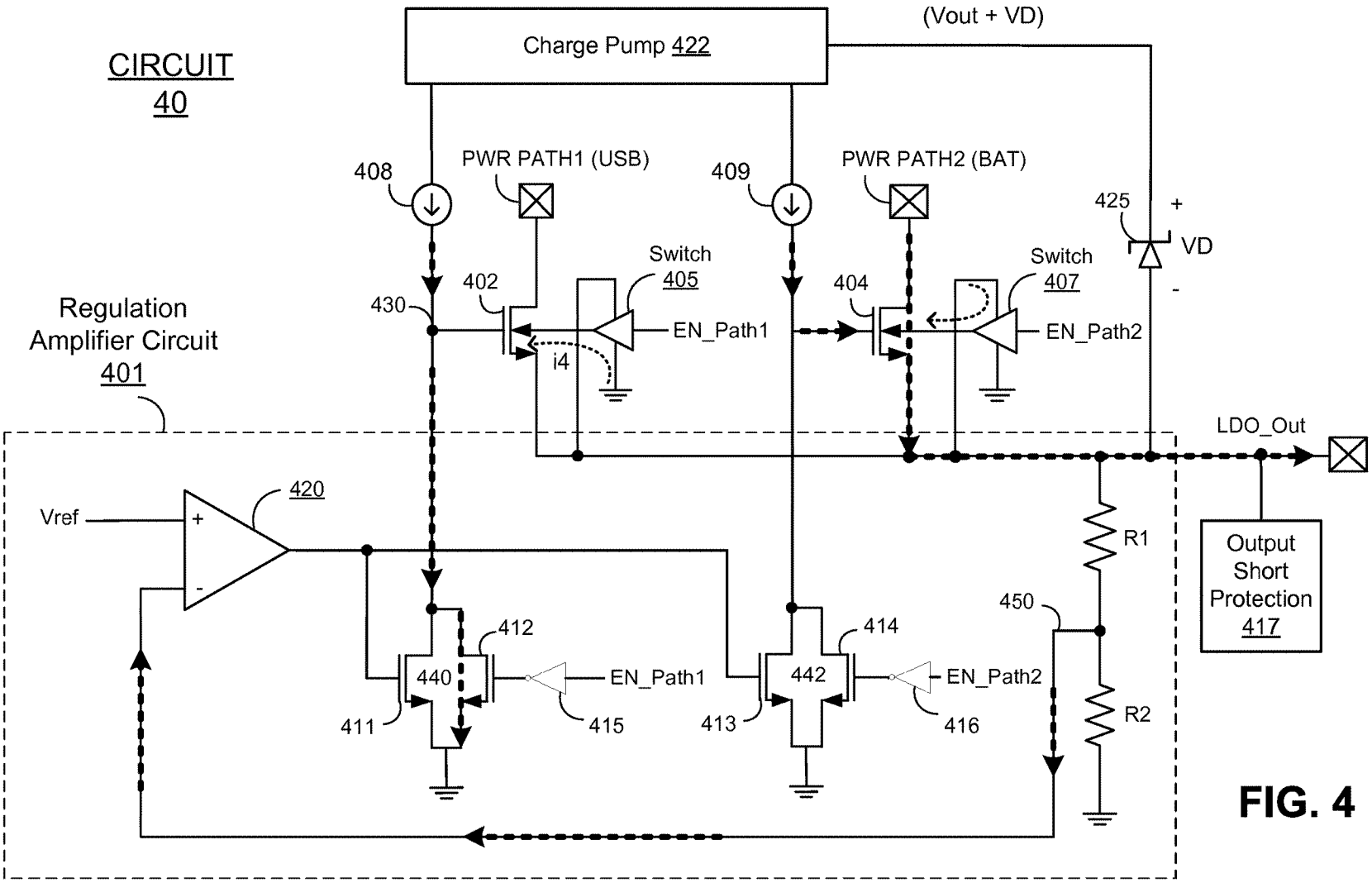
FIG. 4 depicts an equivalent circuit diagram of the example embodiment of the two-input LDO regulator circuit configuration of FIG. 2 when the second power transistor in the second power path is conducting and the gate and backgate of the first power transistor in the first power path is connected to ground potential.

FIG. 4 depicts an equivalent circuit diagram of the example embodiment of the two-input LDO regulator circuit configuration of FIG. 2 when the second power transistor in the second power path is conducting and the gate and backgate of the first power transistor in the first power path is connected to ground potential. In the illustrated embodiment, circuit 40 includes a first power path from a first power source PWR_SRC1 (USB) through a first power NFET 402 to the output of the LDO regulator circuit LDO_Out, and a second power path from a second power source PWR_SRC2 (Battery) through a second power NFET 404 to the output LDO_Out. A first switch circuit 305 is coupled with the body terminal of the first power NFET 302 to selectively connect the body terminal of NFET 402 to ground based on the polarity of the first power path enable signal EN_Path1 received at the input of the first switch circuit 405. A second switch circuit 407 is coupled with the body terminal of the second power NFET 404 to selectively connect the body terminal of NFET 404 to ground based on the polarity of the second power path enable signal EN_Path2 received at the input of the switch circuit 407.

As shown in the illustrated embodiment of FIG. 4, when the second power path is enabled and conducting, the body terminal of the first power NFET 402 is selectively connected to ground potential via the first switch 405 based on the polarity of the first path enable signal EN_Path1. The tristate buffer switch 405 is closed and current i4 conducts, thus connecting the body terminal of the first power FET 402 to ground. When the second power NFET 404 is enabled and conducting power from the second input power source PWR_SRC2 to the output LDO_Out, the polarity of the second power path enable signal EN_Path2 can be set high (i.e., logic state 1) and the polarity of the first power path enable signal EN_Path1 can be set low (i.e., logic state 0). The second switch 407 coupled with the body terminal of the second power NFET 404 will be in its Hi-Z state and the first switch 405 coupled with the body terminal of the first power NFET 402 will be conducting and will connect the body terminal of the first power NFET 402 to ground.

Circuit 40 further includes a regulation amplifier circuit 401 coupled with the first and second power paths. The regulation amplifier circuit 401 includes a first pass gate circuit 440 comprising NFET devices 411 and 412, a second pass gate circuit 442 comprising NFET devices 413 and 414, and an operational amplifier 420. The first pass gate circuit 440 is coupled between ground and a first current source 408. The second pass gate circuit 442 is coupled between ground and a second current source 409. In this example, the second current source 409 activates the gate terminal of the second power NFET 404 to permit power to flow through the second power path from the second power source PWR_SRC2 to the output LDO_Out. As shown, the first current source 408 drives current to ground via NFET 412 of the first pass gate circuit 440.

The operational amplifier 420 includes a first input terminal configured to receive a reference voltage Vref and a second input terminal coupled to receive a feedback voltage from a resistor divider network comprising resistors R1 and R2 coupled with the output LDO_Out. The operational amplifier 420 includes an output voltage configured to regulate the gate terminals of NFET 411 of the first pass gate circuit 440 and NFET 413 of the second pass gate circuit 442. The reference voltage Vref can be set equal to the voltage across resistor R1 subtracted from the value of the output voltage at the output LDO_Out when the LDO regulator circuit 40 is conducting power. The first pass gate circuit 440 is selectively activated based on the first power path enable signal EN_Path1 received at the gate terminal of NFET 412. The second pass gate 442 is selectively deactivated (and thus floating) based on the polarity of the second power path enable signal EN_Path2 received at the gate terminal of NFET 414 of the first and second pass gate circuits 440 and 442, respectively.

As shown in the illustrated embodiment of FIG. 4, when power is conducting in the second power path, the second path enable signal EN_Path2 will be active (and EN_Path1 will be inactive) and NFET 412 of the first pass gate circuit 440 will be activated based on the polarity of the first power path enable signal EN_Path1. NFET 414 of the second pass gate circuit 442 will be deactivated (and floating) because the second power path enable signal EN_Path2 received at the gate terminal of NFET 414 will be inverted to a low logic state via inverter circuit 416. In this configuration, power conducts in the second power path and the first power path is coupled with ground.

Similar in functionality to the discussion above with respect to FIG. 2, circuit 40 further includes a charge pump circuit 422, a zener diode clamp circuit 425 (or other voltage clamp), and an output short protection circuit 417. This completes the description of LDO regulator circuit 40 according to one example embodiment.

Figure 5:
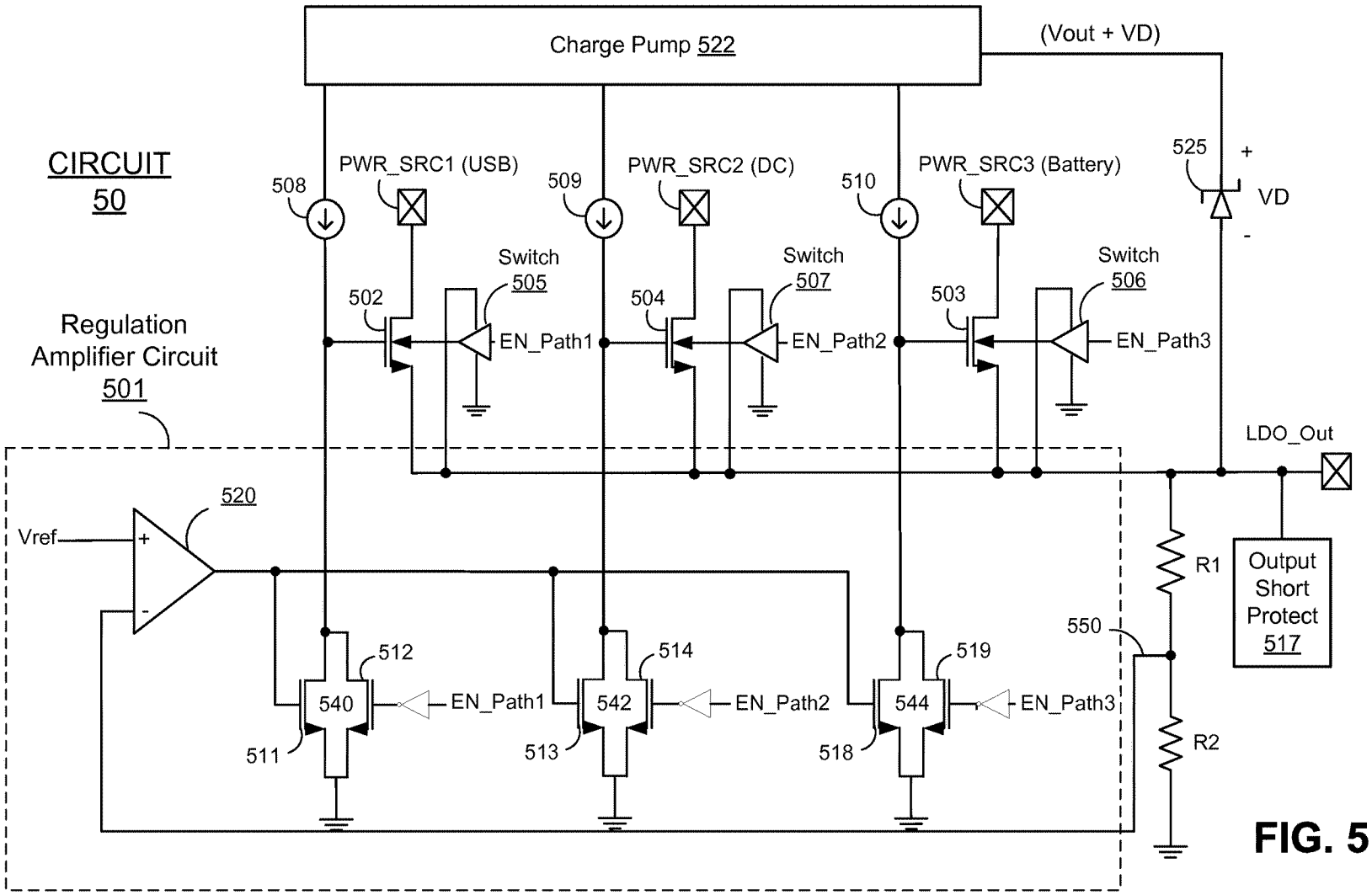
FIG. 5 depicts a circuit diagram of an example embodiment of a three-input LDO regulator circuit configuration including a single transistor in the power path.

FIG. 5 depicts a circuit diagram of an example embodiment of a three-input LDO regulator circuit configuration including a single transistor in the power path. As can be seen from this illustrated embodiment, a third power path having a third DC power source input has been added to the circuit configuration 50. It will be appreciated that any number of power paths can be used with the circuit techniques described herein.

Circuit 50 includes three power paths including a first power path from PWR_SRC1 (USB) through a first power FET 502 to the output LDO_Out of the LDO regulator circuit 50, a second power path from PWR_SRC2 (DC) through a second power FET 504 to the output LDO_Out, and a third power path from PWR_SRC3 (Battery) through a third power FET 503 to the output LDO_Out. A first switch circuit 505 is coupled with the body terminal of the first power NFET 502 to selectively connect the body terminal of NFET 502 to ground based on the polarity of the first power path enable signal EN_Path1 received at the input of the first switch circuit 505. A second switch circuit 507 is coupled with the body terminal of the second power NFET 504 to selectively connect the body terminal of NFET 504 to ground based on the polarity of the second power path enable signal EN_Path2 received at the input of the switch circuit 507. A third switch circuit 506 is coupled with the body terminal of the third power NFET 503 to selectively connect the body terminal of NFET 503 to ground based on the polarity of the third power path enable signal EN_Path3 received at the input of the switch circuit 506.

In this embodiment and other embodiments having more than two power sources, the power path enable signals are configured such that only one is active at a time. The power path enable signals therefore activate only one of the power paths at any given time based on the polarities of the path enable signals. When the first power path is enabled, the gate and back gate terminals of the second power NFET 504 and the third power NFET 503 are selectively connected to ground potential based on the respective polarities of the second and third path enable signals EN_Path2 and EN_Path3. Likewise, when the second or third power NFETs 504 or 503 are respectively activated and conducting power from the respective input power source to the output LDO_Out, the gate and back gate terminals of the non-activated power NFETs are selectively connected to ground potential via the respective switch circuits and based on the polarity of the respective power enable signals.

The LDO regulator circuit 50 is therefore configured to select which input power source to supply power to the output LDO_Out based on the respective polarities of the first, second and third path enable signals, and to prevent back power leakage from the active power path into one or more of the inactive power paths.

Circuit 50 further includes a regulation amplifier circuit 501 coupled with the first, second and third power paths. The regulation amplifier circuit 501 includes a first pass gate circuit 540 comprising NFET devices 511 and 512, a second pass gate circuit 542 comprising NFET devices 513 and 514, a third pass gate circuit 544 comprising NFET devices 518 and 519, and an operational amplifier 520. The first pass gate circuit 540 is coupled between ground and a first current source 508. The first current source 508 is configured to activate or deactivate the gate terminal of the first power NFET 502 to permit power to flow through the first power path from the first power source PWR_SRC1 to the output LDO_Out. Similarly, the second pass gate circuit 542 and third pass gate circuit 544 are coupled between ground and a second current source 509 or a third current source 510, respectively. The second and third current sources 509 and 510 are configured to activate or deactivate the gate terminals of the second and third power NFETs 504 and 503, respectively, to permit power to flow through the second and third power paths from the second and third power sources PWR_SRC2 and PWR_SRC3, respectively, to the output LDO_Out.

The operational amplifier 520 includes a first input terminal configured to receive a reference voltage Vref and a second input terminal coupled to receive a feedback voltage from a resistor divider network comprising resistors R1 and R2 coupled with the output LDO_Out. The operational amplifier 520 includes an output voltage coupled with the gate terminals of NFET 511 of the first pass gate circuit 540, NFET 513 of the second pass gate circuit 542, and NFET 518 of the third pass gate circuit 544. The reference voltage Vref can be set equal to the voltage across resistor R1 subtracted from the value of the output voltage at LDO_Out when the LDO regulator circuit 50 is conducting power.

The output of the operational amplifier 520 regulates the gate terminals of NFETs 511, 513 and 518 of the first, second and third pass gate circuits 540, 542, and 544, respectively. The first, second and third pass gate circuits 540, 542 and 544 are selectively activated or deactivated based on the first, second and third power path enable signals EN_Path1, EN_Path2, EN_Path3 received at the gate terminals of NFETs 512, 514 and 519 of the first, second and third pass gate circuits 540, 542 and 544, respectively.

Only one of the pass gate circuits 540, 542 or 544 will conduct at any given time based on the polarities of the first, second and third power path enable signals. When the first power path is active and conducting, switch circuits 507 and 506 of the second and third power paths and the second and third pass gate circuits 542 and 544, respectively, work together to connect the gate and back gate terminals of the second and third power FETs 504 and 503 to ground. When the second power path is active and conducting, switch circuits 505 and 506 and the first and third pass gate circuits 540 and 544, respectively, work together to connect the gate and back gate terminals of the first and third power FETs 502 and 503 to ground. And when the third power path is active and conducting, switches 505 and 507 and the first and second pass gate circuits 540 and 542, respectively, work together to selectively connect the gate and back gate terminals of the first and second power FETs 502 and 504 to ground.

Similar in functionality to the discussion above with respect to FIG. 2, circuit 50 further includes a charge pump circuit 522, a zener diode clamp circuit 525, and an output short protection circuit 517. This completes the description of LDO regulator circuit 50 according to one example embodiment.

II. Exemplary Processes

The processes described below are exemplary in nature and are provided for illustrative purposes and not intended to limit the scope of the embodiments described herein to any particular example embodiment. For instance, processes in accordance with some embodiments may include or omit some or all of the operations described below, or may include steps in a different order than described herein. The particular processes described are not intended to be limited to any particular set of operations exclusive of all other potentially intermediate operations.

In addition, the operations may be embodied in computer-executable code, which causes a general-purpose or special-purpose computer to perform certain functional operations. In other in stances, these operations may be performed by specific hardware components or hardwired circuitry, or by any combination of programmed computer components and custom hardware circuitry.

Figure 6A:
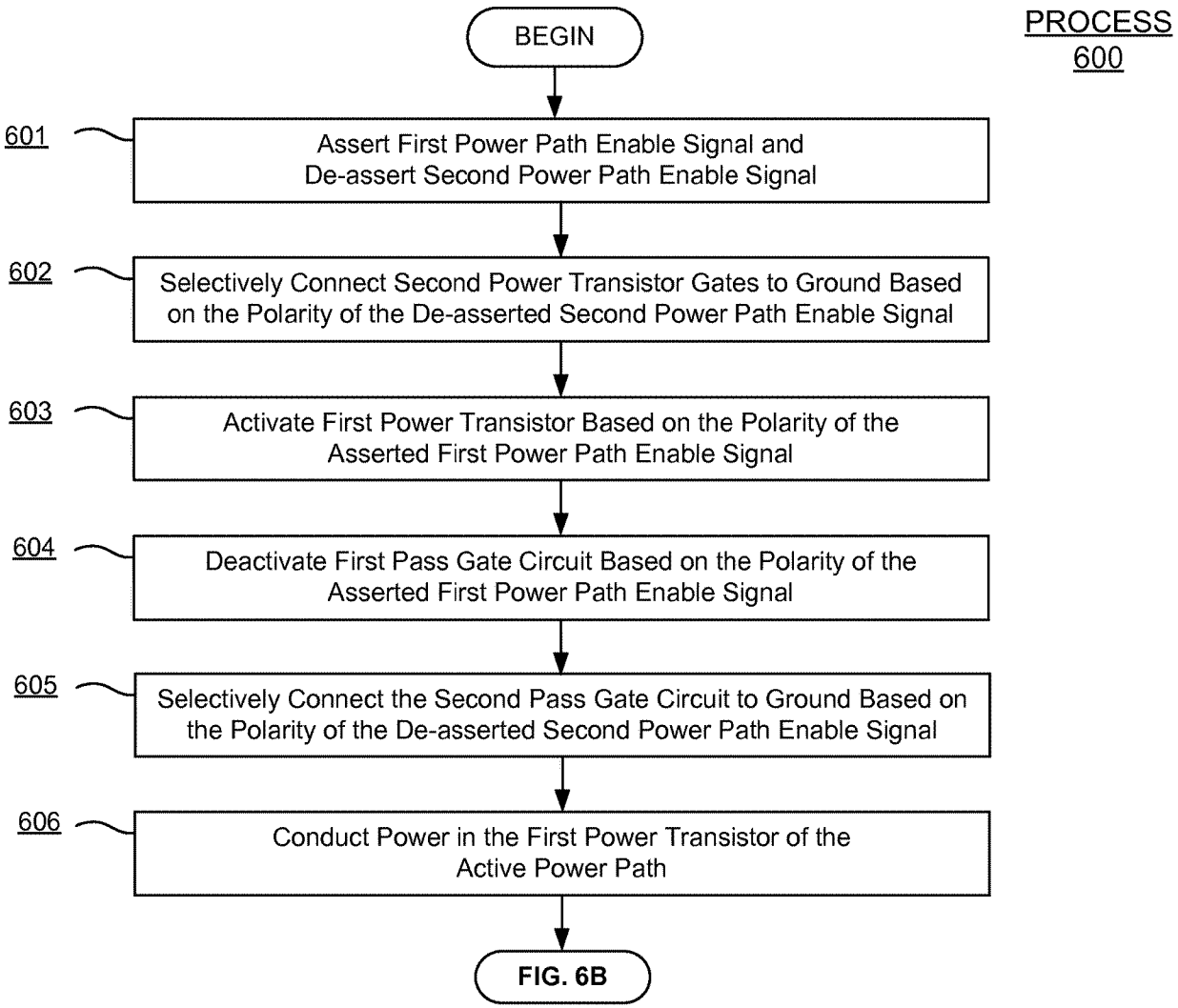
FIGS. 6A-6B depict a flow chart of an example embodiment of a process in a multiple input LDO regulator circuit configuration according to the techniques described herein.
Figure 6B:
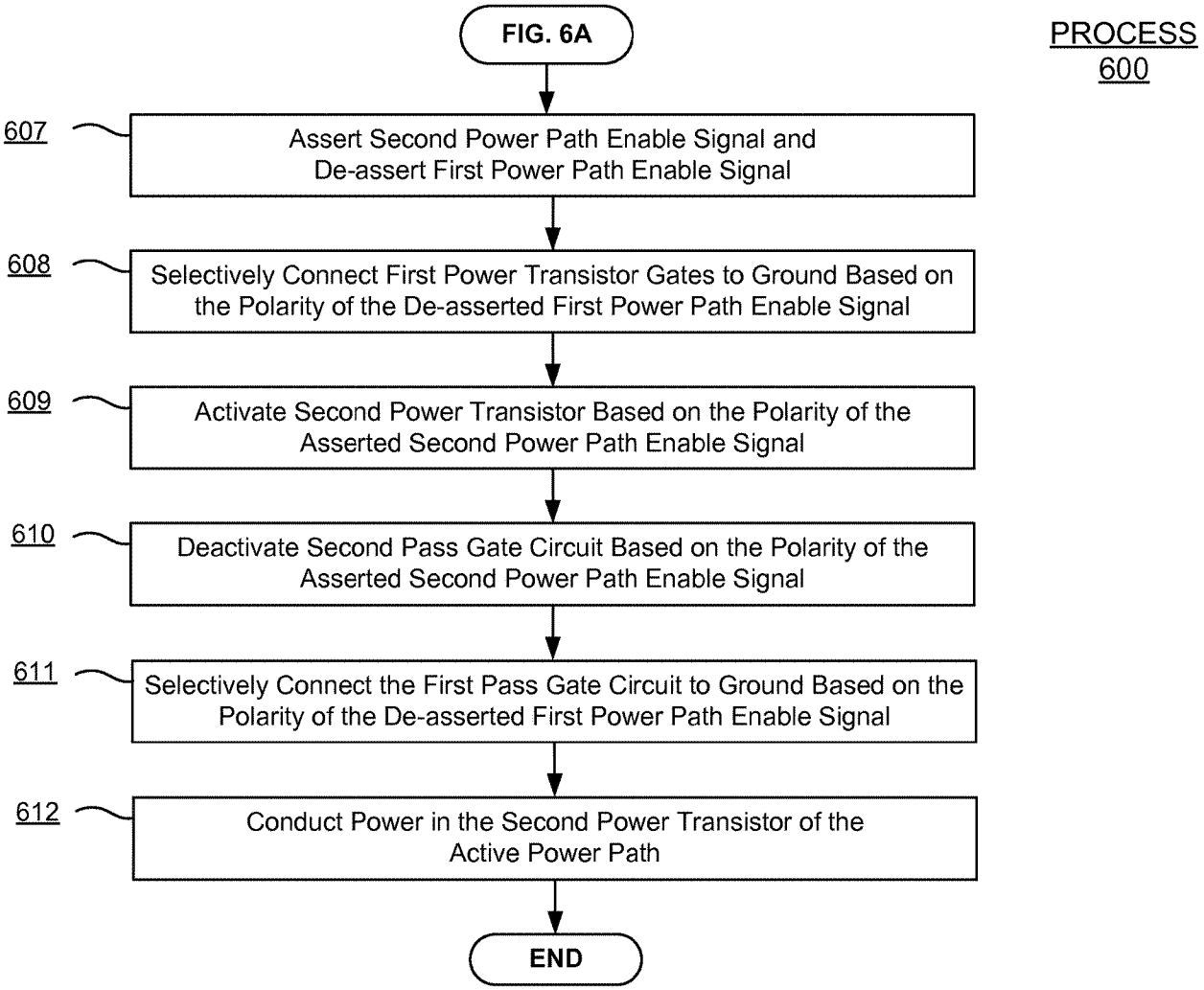

FIGS. 6A-6B depict flow charts of an example embodiment of a process in a multiple input regulator circuit configured according to the techniques described herein. In at least certain embodiments, the multiple input regulator circuit may include a multiple input LDO regulator circuit. Process 600 begins at operation 601 by asserting a first power path enable signal at a first power path of the regulator circuit and de-asserting a second power path enable signal at a second power path of the regulator circuit. The first and second power path enable signals are configured such that when one is asserted, the other is de-asserted, and vice versa. Process 600 continues by selectively connecting the gate and backgate of the second power transistor to ground potential based on the polarity of the de-asserted second power path enable (operation 602).

Referring to FIG. 2, the first power path comprises a first power transistor coupled between a first input power source (e.g., USB) and the output of the regulator circuit, and a first switch having an output coupled with the body terminal of the first power transistor. The second power path comprises a second power transistor coupled between a second input power source (e.g., battery) and the output of the regulator circuit, and a second switch with an output coupled with the body terminal of the second power transistor.

Process 600 continues by activating the first power transistor of the first power path based on the polarity of the asserted first power path enable signal (operation 603). The regulator circuit is configured to selectively connect either the body terminal of the first power transistor to ground based on the polarity of a first path enable signal, or to connect the body terminal of the second power transistor to ground potential based on the polarity of a second path enable signal. Thus only one of the first power transistor and the second power transistor is active at a time based on the polarities of the first and second power path enable signals.

When the first power transistor is conducting power from the USB input power source to the output of the regulator circuit (see FIG. 3), the gate and back gate terminals of the second power transistor are selectively connected to ground potential based on the polarity of the second path enable signal, and when the second power transistor is conducting power from the battery input power source to the output of the regulator circuit (see FIG. 4), the gate and back gate terminals of the first power transistor are selectively connected to ground potential based on the polarity of the first power enable signal.

Using this technique, the first and second power paths are isolated from one another. This circuit configuration prevents back power leakage from the active power path into one or more of the inactive power paths. In addition, as discussed above, the regulator circuit includes only has a single power transistor connected in series from the input power source to the output of the regulator circuit. This single power transistor provides both power source selection and power source regulation functions. Such a circuit configuration is unlike the prior art circuit configurations requiring at least two or more transistors connected in series in the power path.

Process 600 continues at operation 604 by deactivating a first pass gate circuit coupled with the gate terminal of the first power transistor based on the polarity of the asserted first power path enable signal. The first pass gate circuit is coupled between ground potential and a current source configured to activate and deactivate the gate terminal of the first power transistor. The gate and back gate terminals of the second pass gate circuit are selectively connected to ground potential based on the polarity of the de-asserted second power path enable signal (operation 605). The second pass gate circuit is coupled between ground potential and a current source configured to activate and deactivate the gate terminal of the second power transistor. Power can then conduct in the active power path while the one or more inactive power paths are selectively connected to ground (operation 606).

Referring to FIG. 6B, process 600 continues at operation 607 by asserting the second power path enable signal at the second power path of the regulator circuit and de-asserting the first power path enable signal at the first power path of the regulator circuit. Process 600 continues by selectively connecting the body terminal of the first power transistor of the first power path to ground potential based on the polarity of the de-asserted first power path enable (operation 608). The second power transistor of the second power path is activated based on the polarity of the asserted second power path enable signal (operation 609).

Process 600 continues at operation 610 where the second pass gate circuit coupled with the gate terminal of the second power transistor is deactivated based on the polarity of the asserted second power path enable signal (operation 610). The second pass gate circuit is coupled between ground potential and the current source configured to activate and deactivate the second power transistor. The gate and back-gate terminals of the first pass gate circuit are selectively connected to ground potential based on the polarity of the de-asserted first power path enable signal (operation 611). The first pass gate circuit is coupled between ground potential and the current source configured to activate and deactivate the first power transistor. Power can then conduct in the active power path while the one or more inactive power paths are selectively connected to ground (operation 612). This completes process 600 according to one example embodiment.

The proposed circuit techniques described herein are therefore capable of using a single transistor in each power path of the multiple input regulator circuit to replace both the power MUX transistor and the power regulation transistor. The circuit configuration described herein can save up to six (6) times the integrated circuit area with the same functionality as compared to conventional designs using a power selection MUX transistor and a separate power regulation transistor. The back gate switches are configured to connect the body terminal of the power transistor to ground potential to completely isolate power paths when the channel is turned off. This also prevents any back power leakage into the inactive power paths.

In addition, one power regulation amplifier can be shared among multiple power paths with the design described herein. Additional power paths can be added by simply adding a single power NFET device and sharing the same power amplifier.

III. Exemplary Hardware Implementation

Those of skill would further appreciate that the various illustrative logical blocks, modules, circuits, and algorithm steps described in connection with the embodiments disclosed herein may be implemented as electronic hardware, computer software, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Persons of skill in the art may implement the described functionality in varying ways for each particular application, but such implementation decisions should not be interpreted as causing a departure from the scope of the exemplary embodiments described herein.

The various illustrative logical blocks, modules, and circuits described in connection with the embodiments disclosed herein may be implemented or performed with a general purpose processor, a Digital Signal Processor ("DSP"), an Application Specific Integrated Circuit ("ASIC"), a Field Programmable Gate Array ("FPGA") or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine, etc. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory ("RAM"), flash memory, Read Only Memory ("ROM"), Electrically Programmable ROM ("EPROM"), Electrically Erasable Programmable ROM ("EEPROM"), registers, hard disk, a removable disk, a CD-ROM, or any other form of storage medium known in the art. An exemplary storage medium is coupled with the processor such that the processor can read information from, and write information to, the storage medium. In the alternative, the storage medium may be integrated into the processor.

To the extent the embodiments described herein are implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

Throughout the foregoing description, for the purposes of explanation, numerous specific details were set forth in order to provide a thorough understanding of the invention. It will be apparent, however, to persons skilled in the art that these embodiments may be practiced without some of these specific details. The above examples and embodiments should not be deemed to be the only embodiments, and are presented to illustrate the flexibility and advantages of the present invention. Other arrangements, embodiments, implementations and equivalents will be evident to those skilled in the art and may be employed without departing from the spirit and scope of the invention as defined by the following claims.

What is claimed is:

1. A regulator circuit comprising:

a first power path comprising:

only a single first power transistor connected in series between a first input power source and output of the regulator circuit; and a first switch having an output coupled with a body terminal of the first power transistor to selectively connect the body terminal of the first power transistor to ground potential based on a polarity of a first path enable signal;

at least a second power path comprising:

only a single second power transistor connected in series between a second input power source and the output of the regulator circuit; and a second switch having an output coupled with a body terminal of the second power transistor to selectively connect the body terminal of the second power transistor to ground potential based on a polarity of a second path enable signal, wherein the first path enable signal is received at an input of the first switch and the second path enable signal is received at an input of the second switch, and wherein the regulator circuit is configured to select which input power source supplies power to the output of the regulator circuit based on the polarities of the first and second path enable signals, and to prevent back power leakage from an active power path into one or more inactive power paths.

2. The regulator circuit of claim 1 wherein the single first and second power transistors provide both power source selection and power source regulation functions of the regulator circuit.

3. The regulator circuit of claim 1 wherein the first path enable signal and the second path enable signal are configured to activate only one of the first power path and the second power path at a time based on the polarities of the first and second path enable signals.

4. The regulator circuit of claim 1 wherein when the first power transistor is conducting power from the first input power source to the output of the regulator circuit, the gate and body terminals of the second power transistor are selectively connected to ground potential based on the polarity of the second path enable signal, and wherein when the second power transistor is conducting power from the second input power source to the output of the regulator circuit, the gate and body terminals of the first power transistor are selectively connected to ground potential based on the polarity of the first path enable signal.

5. The regulator circuit of claim 1 further comprising a regulation amplifier circuit including:

a first pass gate circuit coupled between ground potential and a first current source configured to activate and deactivate the first power transistor;

a second pass gate circuit coupled between ground potential and a second current source configured to activate and deactivate the second power transistor; and an operational amplifier having an output coupled with a first input gate of the first pass gate circuit and a first input gate of the second pass gate circuit to selectively connect one of the gate terminal of the first pass gate circuit or the second pass gate circuit to ground potential based on the respective polarities of the first and second path enable signals.

6. The regulator circuit of claim 5 wherein the operational amplifier further comprises a first input terminal coupled to receive a reference voltage and a second input terminal coupled to receive a feedback voltage from a resistor divider network coupled with the output of the regulator circuit.

7. The regulator circuit of claim 6 wherein a second input gate of the first pass gate circuit is configured to receive the first path enable signal and a second input gate of the second pass gate circuit is configured to receive the second path enable signal, wherein only one of the first pass gate circuit and the second pass gate circuit is active at a time based on the polarities of the first and second path enable signals.

8. The regulator circuit of claim 1 further comprising a diode coupled between the output of the regulator circuit and a charge pump circuit to maintain output of the charge pump circuit within a specified range.

9. The regulator circuit of claim 1 further comprising:

a third power path comprising:

only a single third power transistor connected in series between a third input power source and the output of the regulator circuit; and a third switch having an output coupled with a body terminal of the third power transistor to selectively connect the body terminal of the third power transistor to ground potential based on the polarity of a third path enable signal, wherein the third path enable signal is received at the input of the third switch, and wherein the regulator circuit is configured to select which input power source supplies power to the output of the regulator circuit based on the polarities of the first, second, and third path enable signals.

10. A method in a regulator circuit comprising:

receiving a first path enable signal at a first power path comprising:

only a single first power transistor connected in series between a first input power source and output of the regulator circuit; and a first switch having an output coupled with a body terminal of the first power transistor;

receiving at least a second path enable signal at a second power path comprising:

only a single second power transistor connected in series between a second input power source and the output of the regulator circuit; and a second switch having an output coupled with a body terminal of the second power transistor;

selectively connecting either the body terminal of the first power transistor to ground potential based on a polarity of a first path enable signal or the body terminal of the second power transistor to ground potential based on a polarity of a second path enable signal; and activating only one of the first power path and the second power path at a time based on the polarities of the first and second path enable signals.

11. The method of claim 10 further comprising preventing back power leakage from an active power path into one or more inactive power paths.

12. The method claim 10 wherein the single first and second power transistors provide both power source selection and power source regulation functions of the regulator circuit.

13. The method of claim 10 further comprising selectively connecting the body terminal of the second power transistor in the second power path to ground potential based on the polarity of the second path enable signal when the first power transistor in the first power path is conducting power from the first input power source to the output of the regulator circuit.

14. The method of claim 10 further comprising selectively connecting the body terminal of the first power transistor in the first power path to ground potential based on the polarity of the first path enable signal when the second power transistor in the second power path is conducting power from the second input power source to the output of the regulator circuit.

15. The method of claim 10 further comprising selectively connecting to ground potential either a first pass gate circuit coupled between ground potential and a first current source configured to activate and deactivate the first power transistor or a second pass gate circuit coupled between ground potential and a second current source configured to activate and deactivate the second power transistor.

16. The method of claim 10 further comprising maintaining output of a charge pump circuit within a specified range using a diode coupled between the charge pump circuit and the output of the regulator circuit.

17. The method of claim 10 further comprising:

receiving a third path enable signal at a third power path comprising:

only a single third power transistor connected in series between a third input power source and the output of the regulator circuit; and a third switch having an output coupled with a body terminal of the third power transistor to selectively connect the body terminal of the third power transistor to ground potential based on the polarity of a third path enable signal, wherein the third path enable signal is received at an input of the third switch, and wherein the regulator circuit is configured to select which input power source supplies power to the output of the regulator circuit based on the respective polarities of the first, second, and third path enable signals.

18. A regulator circuit means comprising:

means for receiving a first path enable signal at a first power path comprising:

only a single first power transistor connected in series between a first input power source and output of the regulator circuit; and a first switch having an output coupled with a body terminal of the first power transistor;

means for receiving at least a second path enable signal at a second power path comprising:

only a single second power transistor connected in series between a second input power source and the output of the regulator circuit; and a second switch having an output coupled with a body terminal of the second power transistor;

means for selectively connecting either the body terminal of the first power transistor to ground potential based on a polarity of a first path enable signal or the body terminal of the second power transistor to ground potential based on a polarity of a second path enable signal; and means for activating only one of the first power path and the second power path at a time based on the polarities of the first and second path enable signals.

19. The regulator circuit means of claim 18 further comprising means for preventing back power leakage from an active power path into one or more inactive power paths.

20. The regulator circuit means of claim 18 wherein the single first and second power transistors provide both power source selection and power source regulation functions of the regulator circuit.

21. The regulator circuit means of claim 18 further comprising means for selectively connecting the body terminal of the second power transistor in the second power path to ground potential based on the polarity of the second path enable signal when the first power transistor in the first power path is conducting power from the first input power source to the output of the regulator circuit.

22. The regulator circuit means of claim 18 further comprising means for selectively connecting the body terminal of the first power transistor in the first power path to ground potential based on the polarity of the first path enable signal when the second power transistor in the second power path is conducting power from the second input power source to the output of the regulator circuit.

23. The regulator circuit means of claim 18 further comprising means for selectively connecting to ground potential either a first pass gate configured to activate and deactivate the first power transistor or a second pass gate circuit configured to activate and deactivate the second power transistor.

24. The regulator circuit means of claim 18 further comprising:

means for receiving a third path enable signal at a third power path comprising:

only a single third power transistor connected in series between a third input power source and the output of the regulator circuit; and a third switch having an output coupled with a body terminal of the third power transistor to selectively connect the body terminal of the third power transistor to ground potential based on the polarity of a third path enable signal, wherein the third path enable signal is received at an input of the third switch, and wherein the regulator circuit is configured to select which input power source supplies power to the output of the regulator circuit based on the respective polarities of the first, second, and third path enable signals.

* * * * *